US008064787B2

(12) United States Patent
Blair et al.

(10) Patent No.: US 8,064,787 B2
(45) Date of Patent: Nov. 22, 2011

(54) FUSER LIFE EXTENSION

(75) Inventors: Bryan Michael Blair, Lexington, KY (US); James Allen Lokovich, Georgetown, KY (US); Gregory Lawrence Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1074 days.

(21) Appl. No.: 11/858,517

(22) Filed: Sep. 20, 2007

(65) Prior Publication Data

US 2009/0080925 A1 Mar. 26, 2009

(51) Int. Cl.
*G03G 15/20* (2006.01)

(52) U.S. Cl. ..... 399/67; 399/69; 399/43

(58) Field of Classification Search ..... 399/43, 399/67, 69

See application file for complete search history.

(56) References Cited

U.S. PATENT DOCUMENTS 5,331,384 A * 7/1994 Otsuka ..... 399/69
6,160,975 A 12/2000 Bartley et al.
6,233,412 B1 * 5/2001 Takahashi et al. ..... 399/69
6,804,478 B2 10/2004 Martin et al.
6,982,781 B2 1/2006 Vetromile et al.
6,999,692 B2 * 2/2006 Shimura et al. ..... 399/69
7,020,424 B2 3/2006 Gilmore et al.
2007/0071475 A1 3/2007 Blair et al.
2007/0071517 A1 3/2007 Blair et al.
2007/0122173 A1 * 5/2007 Mitsuoka et al. ..... 399/69

OTHER PUBLICATIONS

Chih-Hung Chen and Tsai-Bou Yang Dimensional Analysis on Toner Fusing Process, Recent Progress in Toner Technology, 1997; pp. 401-403; Society for Imaging Science and Technology.

* cited by examiner

*Primary Examiner* — David Gray
*Assistant Examiner* — Laura Roth

(57) ABSTRACT

A method for extending the operating life of a fuser used in an electrophotographic imaging apparatus is disclosed. A control algorithm monitors the number of substrates processed over the lifetime of the fuser and adjusts the fusing temperature of the fuser to compensate for changes occurring in the nip forming members of the fuser. The useful lifetime of the fuser is extended while fusing quality is maintained. A corresponding fuser assembly is also disclosed.

14 Claims, 5 Drawing Sheets

FUSER LIFE EXTENSION

FIELD OF THE INVENTION

The present invention relates generally to electrophotographic devices and, more specifically, to techniques for extending fuser life.

BACKGROUND OF THE INVENTION

In electrophotography, an imaging system forms a latent image by exposing select portions of an electrostatically charged photoconductive surface to laser light. Essentially, the density of the electrostatic charge on the photoconductive surface is altered in areas exposed to a laser beam relative to those areas unexposed to the laser beam. The latent electrostatic image thus created is developed into a visible image by exposing the photoconductive surface to toner, which contains pigment components and thermoplastic components. When so exposed, the toner is attracted to the photoconductive surface in a manner that corresponds to the electrostatic density altered by the laser beam. The toner pattern is subsequently transferred from the photoconductive surface to the surface of a print substrate, such as paper, which has been given an electrostatic charge opposite that of the toner. The substrate then passes through a fuser that applies heat and pressure thereto. The applied heat causes constituents including the thermoplastic components of the toner to flow onto the surface and into the interstices between the fibers of the substrate. The applied pressure produces intimate contact between toner and fibers and promotes settling of the toner constituents into these interstitial spaces. As the toner subsequently cools, it solidifies adhering the image to the substrate.

The fuser typically includes cooperating fusing members that form a nip area capable of delivering heat and pressure to the substrate passing through the nip. Exemplary nip forming members include a fuser roll and a backup roll, a fuser roll and a backup belt and a fuser belt and backup roll. A heat source associated with one or both of the nip forming members raises the temperature of the fusing members at the nip area to a temperature required by a particular fusing application. As the substrate passes through the nip area, the toner is adhered to the substrate by the pressure between the nip forming members at the nip area and the heat resident in the fusing region.

Successful adherence of the toner to the substrate, known as fusegrade, is determined by fusing parameters including temperature, pressure and time in the nip area. Poor fusegrade, resulting in poor adhesion of the toner to the substrate, may be caused by insufficient temperature, pressure or time in the nip area. Moreover, excessive temperature, pressure or time in the nip area may cause damage to the toner image known as image mottle. Excessive temperature, pressure or time in the nip area may also cause the toner to stick to the fusing members rather than the substrate. For example, the toner may peel from the substrate and stick to the fuser members, a condition known as hot offset, or the toner with substrate attached may wrap about a fusing member.

In order to achieve proper fusegrade, the fuser parameters should ideally be maintained within an operating window defined between parameter values that result in poor fusegrade and parameter values that may result in image mottle, hot offset and/or wrap.

SUMMARY OF THE INVENTION

In accordance with an aspect of the present invention, a method of controlling a fusing temperature in a fuser assembly is provided. The method may comprise setting a temperature setpoint value to a predetermined initial value, setting a fusing temperature to correspond with the temperature setpoint value at least during fusing operations, providing a predetermined count threshold corresponding to a substrate count event, counting a number of substrates conveyed through the fuser assembly defining a substrate count, comparing the substrate count to the predetermined count threshold and performing a temperature compensation if the substrate count corresponds to the predetermined count threshold.

Performing a temperature compensation if the substrate count corresponds to the predetermined count threshold may comprise adjusting the temperature setpoint value to a compensated temperature setpoint value and adjusting the fusing temperature to correspond with the compensated temperature setpoint value. The compensated temperature setpoint value may be configured to extend the operating life of the fuser assembly.

In accordance with another aspect of the present invention, a fuser assembly within an image forming apparatus having a paper path along which substrates travel through the image forming apparatus is provided. The fuser assembly may comprise a fusing member, a backup member cooperating with the fusing member to form a fusing region at a nip therebetween for fusing images onto substrates passing through the nip and a heating structure associated with at least one of the fusing member and the backup member for heating the fusing region to a fusing temperature at least during fusing operations. The fusing temperature may correspond to a temperature setpoint value and the temperature setpoint value may be set to a predetermined initial value.

The fuser assembly may further comprise a conveying structure for conveying substrates along the paper path into the nip, a substrate detector for determining a number of substrates passing through the nip and a controller for controlling the fusing temperature. The controller may count the number of substrates passing through the nip defining a substrate count. The controller may compare the substrate count to the predetermined count threshold and perform a temperature compensation if the substrate count corresponds to the predetermined count threshold.

The temperature compensation may adjust the temperature setpoint value to a compensated temperature setpoint value and may adjust the fusing temperature to correspond to the compensated temperature setpoint value. The compensated temperature setpoint value may be configured to extend the operating life of the fuser assembly.

BRIEF DESCRIPTION OF THE DRAWINGS

The following detailed description of the preferred embodiments of the present invention can best be understood when read in conjunction with the following drawings, where like structure is indicated with like reference numerals, and in which.

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

According to an aspect of the present invention, an operating lifetime of a fuser assembly for use in an electrophotographic imaging apparatus may be extended by counting a number of fusing operations performed by the fuser assembly and adjusting a fusing temperature when a predetermined number of fusing operations have been performed. The fusing temperature may be adjusted to a higher temperature or to a lower temperature and the adjustment may be made at one or more predetermined counting events during the lifetime of the fuser assembly. Moreover, the changes to the fusing temperature may be selected so as to maintain the fusing temperature within a predefined temperature operating window. The fusing temperature adjustments may be selected, for example, to compensate for changes that occur in fuser components as a result of use.

Figure 1:
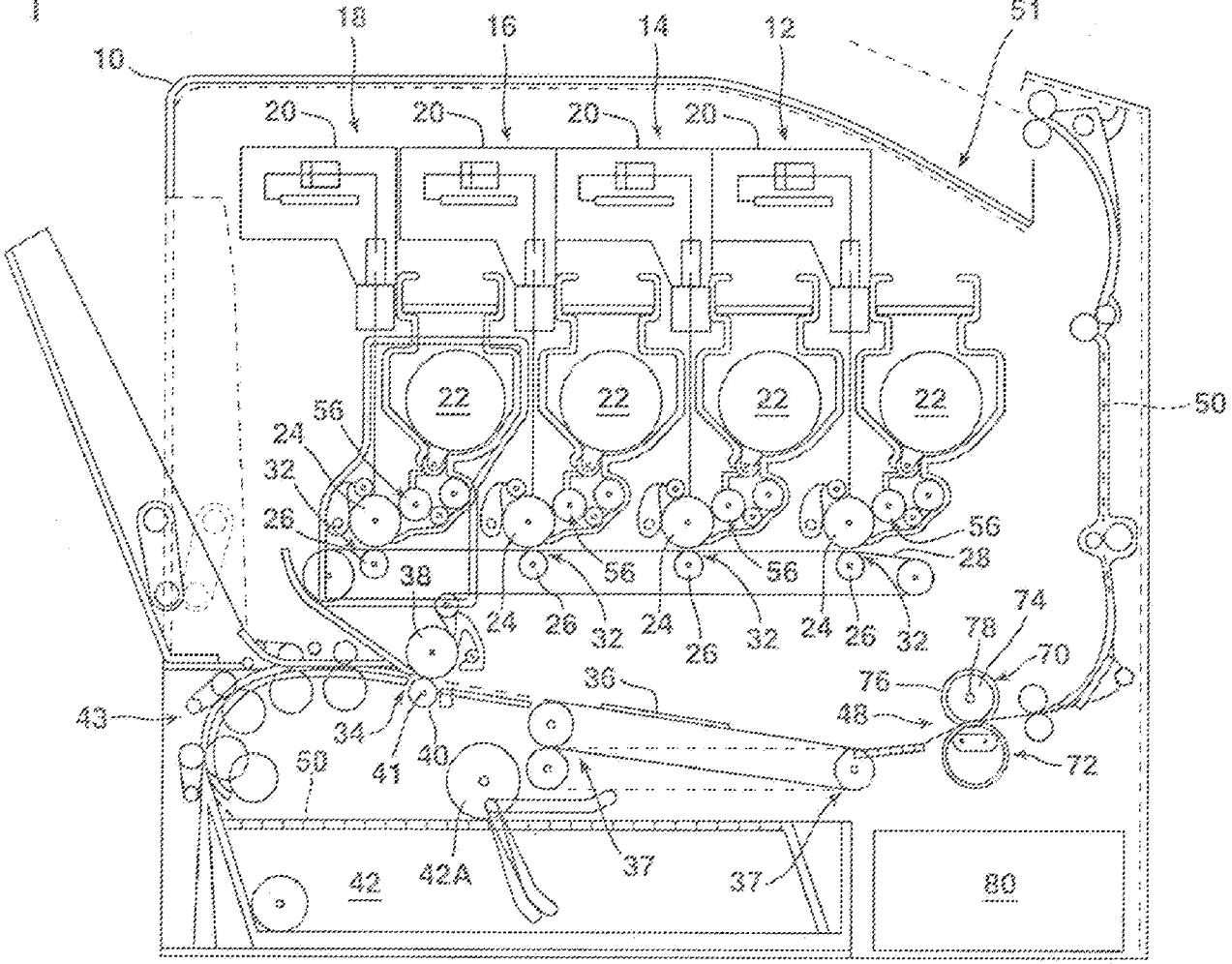
FIG. 1 is a diagrammatic side view of an electrophotographic printer illustrating an image forming apparatus, a substrate conveying structure and a fuser assembly.

Referring now to FIG. 1, a color electrophotographic (EP) printer 10 is illustrated including four image forming stations 12, 14, 16, 18 for creating yellow (Y), cyan (C), magenta (M) and black (K) toner images. Each image forming station 12, 14, 16 and 18 includes a laser printhead 20, a toner supply 22, a rotatable photoconductive (PC) drum 24 and a developing assembly 56. A uniform charge is provided on each PC drum 24, which is selectively dissipated by a scanning laser beam generated by its corresponding printhead 20, such that a latent image is formed on each PC drum 24 according to a bitmap image file of an associated one of the CYMK color image planes. The latent image formed on each PC drum 24 is then developed during an image development process via the corresponding toner supply 22 and developing assembly 56, in which electrically charged toner particles are transferred to the surface of each PC drum 24 in a pattern corresponding to the latent image formed thereon.

Each image forming station also includes an electrically biased transfer roller 26 that opposes its corresponding PC drum 24. An intermediate transfer member (ITM) belt 28 that is common to each image transfer station travels in an endless loop and passes through a nip defined between each PC drum 24 and its corresponding transfer roller 26. The toner image developed on each PC drum 24 is transferred during a first transfer operation to the ITM belt 28 by an electrically biased roller transfer operation. In this regard, each PC drum 24 and its corresponding transfer roller 26 constitutes a first image transfer station 32 that transfers its corresponding one of the yellow, cyan, magenta or black toner images to the ITM belt 28.

At a second image transfer station 34, a composite toner image, i.e., the registered yellow (Y), cyan (C), magenta (M) and black (K) toner images, is transferred from the ITM belt 28 to a substrate 36. The second image transfer station 34 includes a backup roller 38, on the inside of the ITM belt 28, and a transfer roller 40, positioned opposite the backup roller 38. Substrates 36, such as paper, cardstock, labels, envelopes or transparencies, are fed from a substrate supply 42 to the second image transfer station 34 so as to be in registration with the composite toner image on the ITM belt 28. Structure for conveying substrates from the supply 42 to the second image transfer station 34 may comprise a pick mechanism 42A that draws a top sheet from the supply 42 and a speed compensation assembly 43. The composite image is then transferred from the ITM belt 28 to the substrate 36. A conveying structure 37 conveys the substrate 36 to a fuser assembly 48, where the toner image is fused to the substrate 36. The substrate 36 including the fused toner image continues along a paper path 50 until it exits the printer 10 into an exit tray 51.

The paper path 50 taken by the substrates 36 in the printer 10 is illustrated schematically by a dot-dashed line in FIG. 1. It will be appreciated that other printer configurations having different paper paths may be used. Further, a duplex unit (not shown) for printing on both sides of the print media and one or more additional media supplies or trays, including manually fed media trays, may be provided.

The fuser assembly 48 in the illustrated embodiment includes a fuser hot roller 70 or fusing roller defining a heating member, and a backup member 72 cooperating with the hot roller 70 to define a nip for conveying substrates 36 therebetween. The hot roller 70 may comprise a hollow metal core member 74 covered with a thermally conductive elastomeric material layer 76. The hot roller 70 may also include a polyperfluoroalkoxy-tetrafluoroethylene (PFA) sleeve (not shown) around its elastomeric material layer 76. A heating element 78, such as a halogen tungsten-filament heater, may be located inside the core 74 of the hot roller 70 for providing heat energy to the hot roller 70 under control of a controller 80. The heating element 78 may comprise a filament that provides an end boost along a predetermined portion adjacent at each end of the heating element 78 to provide a greater heat output adjacent the ends than at a central portion of the heating element 78. It should be understood that the illustrated embodiment is not limited to a particular mechanism or structure for heating the hot roller 70 and that any known means of heating a roller may be implemented within the scope of this invention.

The backup member 72 may comprise any structure for cooperating with the hot roller 70 to create a nip whereby a substrate passing through the fuser assembly 48 is pressed into engagement with the hot roller 70. The illustrated backup member 72 comprises a belt backup member. However, it should be understood that the backup member 72 may comprise other nip forming structures including, without limitation, a cooperating backup roller. Additionally, a second heating element may be associated with the backup member 72.

The controller 80 may comprise a microprocessor, a discrete logic array or other device controlling arrangement. The controller 80 may be provided to control various aspects of the printer systems and components, including the fuser assembly 48. Additionally, the controller 80 may be utilized to control the fusing temperature utilized by the fuser assembly 48 in such a way as to extend the life of the fuser assembly 48 as will be described in greater detail herein.

Figure 2:
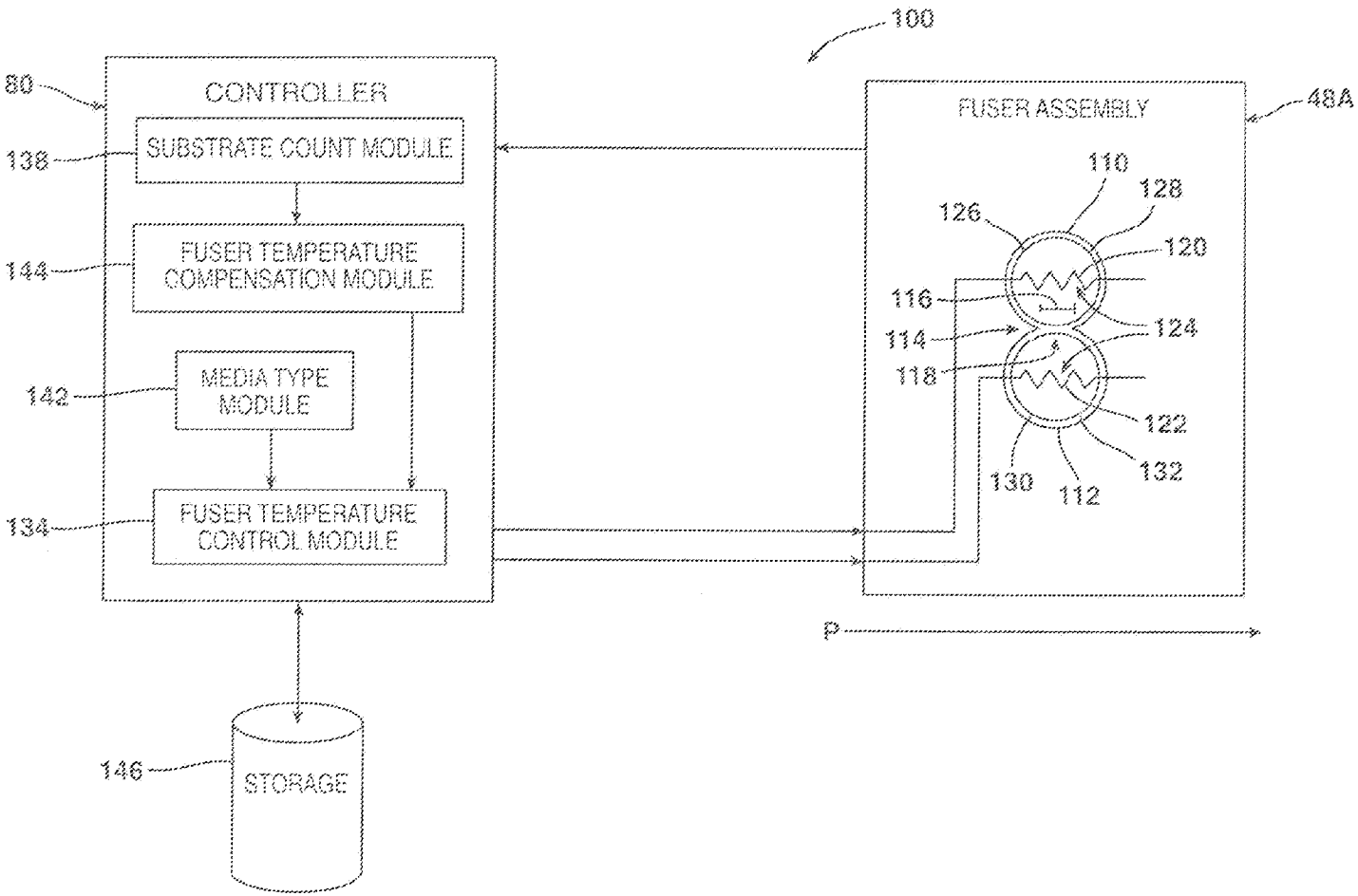
FIG. 2 is a block diagram of an aspect of the present invention illustrating a fuser assembly, a controller and a storage device.

Referring now to FIG. 2, a block diagram 100 illustrates an exemplary fuser assembly 48A and control arrangement according to various aspects of the present invention. The fuser assembly 48A represents another exemplary fuser arrangement that may be utilized in an electrophotographic apparatus, such as the printer 10, as will be described in greater detail below.

As illustrated, the fuser assembly 48A comprises a fusing member 110 and a backup member 112 defining a nip 114 therebetween through which substrates 36 pass. A distance 116 in a process direction P between the fusing member 110 and the backup member 112 within which temperature and pressure are applied to the substrate 36 defines a fusing region 118. As illustrated in FIG. 2, the backup member 112 is a backup roller rather than the belt backup member 72 shown in FIG. 1. A first heating element 120 is associated with the fusing member 110 and a second heating element 122 may be optionally associated with the backup member 112. Together, the first heating element 120 and the optional second heating element 122 comprise a heating structure 124. The heating structure 124 is under the control of the controller 80 as will be described more thoroughly herein.

After a toner image has been transferred to a substrate 36 as previously described with reference to FIG. 1, the substrate 36 is conveyed to the nip 114 by a conveying structure 37 as described with reference to FIG. 1. The toner image comprises unfused toner containing pigment components and thermoplastic components. When the substrate 36 passes through the nip 114, the heat applied to the toner causes constituents including the thermoplastic components in the toner to melt and flow onto the surface and into interstices between the fibers of the substrate 36. The applied pressure produces intimate contact between toner and fibers and promotes settling of the toner constituents into these interstitial spaces. As the toner subsequently cools, it solidifies adhering the image to the substrate 36.

Successful adherence of the toner to the media, known as fusegrade, is determined substantially by the temperature applied to the toner, the pressure applied between the toner image and the substrate surface while the toner is heated and the time that the temperature and pressure are simultaneously applied, i.e., the time in the fusing region 118. If the temperature or pressure applied to the toner is insufficient or the time that the toner spends in the fusing region 118 is too little, the toner may not properly adhere to the substrate, resulting in poor fusegrade. On the other hand, if the temperature or pressure applied to the toner is excessive or the time that the toner spends in the fusing region 118 is too long, the toner may stick to the fusing members rather than the substrate 36. This may cause the toner to peel from the substrate 36 and adhere to the fusing members, a condition known as hot offset. Should the toner adhere sufficiently to both the substrate and the fusing member, the substrate may wrap around the fusing member. Additionally, excessive temperature, pressure or time in the fusing region 118 may damage the toner image, resulting in image mottle.

Fusegrade may be correlated with fusing temperature. As such, in order to achieve proper fusegrade while avoiding image mottle, hot offset and wrap, the fusing temperature may be maintained within a predetermined temperature range, also referred to herein as a temperature operating window. For example, the temperature operating window may define a fusing temperature range that extends from a relatively low temperature just suitable to achieve proper fusegrade to a relatively high temperature that achieves proper fusegrade and avoids image mottle, hot offset and wrap, etc.

Fusegrade may also be correlated with nip pressure times the square of the time in the fusing region 118. The pressure exerted on the toner is determined substantially by the force applied between the fusing member 110 and the backup member 112 divided by the distance 116 that defines the fusing region 118. The pressure may vary between different points in the fusing region 118.

As illustrated in FIG. 2, the fusing member 110 may comprise a hollow metal core 126 surrounded by a thermally conductive elastomeric layer 128. Similarly, the backup member 112 may comprise a hollow metal core 130 surrounded by a thermally conductive elastomeric layer 132. Alternatively, the backup member 112 may comprise any structure for cooperating with the fusing member 110 such that a compressive pressure is applied to opposite sides of the substrate 36 as it is conveyed through the nip 114.

Because one or both of the fusing member 110 and the backup member 112 is compliant at least in the thermally conductive elastomeric layers 128 and 132, respectively, the outer portion of one or both of the fusing member 110 and the backup member 112 deforms in the fusing region 118 defined by the distance 116. For a given pressure between the fusing member 110 and the backup member 112, the amount that the fusing member 110 and/or the backup member 112 deforms will vary substantially in accordance with the hardness of the compliant portions of the fusing member 110 and the backup member 112.

The distance 116 corresponds to the amount of deformation that occurs in the fusing member 110 and the backup member 112. As a result, the distance 116 varies in accordance with the hardness of the fusing member 110 and the backup member 112. In this fashion, the distance 116 is increased as the hardness of the fusing member 110 and the backup member 116, i.e., the nip forming members decreases. Conversely, the distance 116 decreases as the hardness of the nip forming members increases.

The time that the temperature and pressure are applied to the toner, i.e., the time in the fusing region 118, is a function of the distance 116 and the velocity of the substrate 36 as it is conveyed through the nip 114. As previously mentioned, the distance 116 corresponds to the shape and hardness of the fusing member 110 and the backup member 112 and the force applied therebetween. Thus, for a given substrate velocity, the time that the toner spends in the fusing region 118 corresponds to the hardness of the fusing member 110 and the backup member 112.

The compliant portions of the fusing member 110 and the backup member 112 may be harder when new, i.e., at a beginning of fuser life, and may soften with age as a result of repetitive turning under pressure. As a result, the distance 116 may be smaller at the beginning of fuser life and may increase as the fuser assembly ages and the nip forming members soften. The increase in the distance 116 results in a corresponding increasing in time that substrate 36 spends in the fusing region 118 if the substrate velocity remains constant. For this reason, fusegrade may be lower at the beginning of fuser life and may improve with use. Thus, it may be practical to select a fuser operating temperature high enough to achieve adequate fusegrade at the beginning of fuser life. Subsequently, as the nip forming members age and soften, resulting in an increase in the distance 116 and a corresponding increase in the time that the substrate 36 spends within the fusing region 118, it may be unnecessary to operate the fuser assembly at the same high temperature in order to achieve adequate fusegrade.

In one example, fusing temperature may refer to the temperature to which the fusing member 110 is regulated. The fusing member may be in contact with a substrate surface upon which an un-fused toner image has been deposited. Backup member temperature may refer to the temperature to which the backup member 112 may be regulated if the backup member 112 is separately heated. Alternatively, backup member temperature may refer to the surface temperature of the backup member 112 if the backup member 112 is heated by contact with the heated fusing member 110 and is not otherwise heated. Backup member temperature may normally be lower than fusing temperature.

The fusing member 110 and the backup member 112 in the fuser assembly 48A illustrated in FIG. 2 have a useful lifetime that is inversely related to fuser operating temperature, hereinafter fusing temperature. The lifetime of the fusing member 110 may correspond to the fusing temperature to which the fusing member 110 is exposed and the lifetime of the backup member 112 may correspond to the backup member temperature to which the backup member 112 is exposed. For example, in accordance with an application of the Arrhenius model in the context of evaluating the effect of temperature on the fuser assembly 48A, it has been observed that the operating life of a fusing member such as fusing member 110 may be extended by a factor of two for every 7 to 10 degree C reduction in fusing temperature.

As previously discussed, the time spent within the fusing region 118 may increase with fuser life due to softening of the nip forming members, resulting in improved fusegrade. As a result, it may be possible to operate the fuser assembly 48A at a reduced fusing temperature at some point later in the lifetime of the fuser assembly 48A while still maintaining adequate fusegrade. By taking advantage of the improvement in fusegrade that may occur due to the softening of the nip forming members with age, it may be possible to extend the operating lifetime of the components of the fuser assembly 48A by reducing the fusing temperature at one or more point (s) in the lifetime of the fuser assembly 48A without producing unacceptable fusegrade.

For example, for a fusing member 110 comprising a metal core 126 surrounded by an elastomeric layer 128, failures generally occur first at the interface between the elastomeric layer 128 and the metal core 126 or within the elastomeric layer 128 because the temperature is highest at these points during fusing operations. By reducing the fusing temperature at some point in the lifetime of the fuser assembly 48A, it may be possible to avoid, postpone or otherwise mitigate such occurrences.

As another illustrative example, the hardness of the nip forming members may decrease sufficiently during the lifetime of the fuser assembly 48A such that the distance 116 of the fusing region 118 increases enough that the time spent in the fusing region 118 is sufficient to cause hot offset, image mottle or wraps if the fusing temperature remains constant over the lifetime of the fuser assembly 48A. In this case it may not be possible to establish a single temperature range that will assure adequate fusegrade while avoiding hot offset, image mottle and/or wraps over the entire operating lifetime of the fuser assembly 48A. As a result, it may be necessary to lower the fusing temperature at some point during the lifetime of the fuser assembly 48A in order to maintain the fusing temperature within the temperature operating window as previously defined. By maintaining the fusing temperature within the temperature operating window so as to avoid hot offset, image mottle and/or wraps it may be possible to operate the fuser assembly 48A beyond a point in fuser life where such conditions might otherwise necessitate maintenance or repair, and a functional life of the fuser assembly 48A may be extended.

As yet a further illustrative example, certain materials sometimes used in fuser nip forming members may harden rather than soften with use. For example, a fuser nip forming member having a soft silicone rubber layer may harden during use as a silicone oil within the rubber is driven out due to repetitive turning under pressure at elevated temperature. As another example, a fuser nip forming member having a rubber layer that is not fully cured may harden during use as the rubber continues to cure when it is exposed to elevated temperature during fusing operations. As the nip forming member hardens, the distance 116 decreases, and the substrate 36 spends less time in the fusing region 118. In this situation, fusegrade generally decreases over the lifetime of the fuser assembly 48A. In order to maintain adequate fusegrade, the fusing temperature may be raised at one or more point(s) during the lifetime of the fuser assembly 48A. Though the higher fusing temperature may decrease the life of the nip forming members as previously discussed, it may be possible to maintain adequate fusegrade beyond a point in fuser life where fusegrade would otherwise become unacceptable if the temperature were not increased. In this fashion, the functional life of the fuser assembly 48A may be extended.

The controller 80 is communicably coupled to the fuser assembly 48A. The controller 80 may comprise a microprocessor, microcontroller, discrete logic array or other controlling arrangement. The controller 80 includes a fuser temperature control module 134 communicating with one or more power switching devices (not shown) connected to the heating structure 124. In this fashion, the fuser temperature control module 134 may cause the power switching device or devices (not shown) to energize the first heating element 120 and/or the second heating element 122 either individually or in conjunction causing the fusing temperature to increase. Conversely, the fuser temperature control module 134 may cause the power switching device or devices (not shown) to de-energize the first heating element 120 and/or the second heating element 122 allowing the fusing temperature to decrease.

The controller 80 also includes a substrate count module 138. The substrate count module 138 is configured to count a number of substrates 36, passing through the fuser assembly 48A. The substrate count module 138 may communicate with a substrate detector in the fuser assembly 48A or elsewhere in the printer 10. The substrate detector may comprise an optoelectronic substrate detector, an electromechanical substrate detector, a paper pick mechanism, a bump sensor, a software implemented substrate detector within the controller 80 or other suitable means for detecting substrates approaching the fuser assembly 48A. In this fashion, a total number of substrates 36 that have passed through the fuser assembly 48A, defining a substrate count, may be compiled.

For example, the substrate detector may comprise an optical interrupter having a mechanical flag that is moved out of an optical path when a substrate 36 is conveyed past the substrate detector. One or more substrate detectors may be provided in a substrate path in the printer 10. Any such substrate detector may communicate with the controller 80 for purposes of counting the number of substrates 36 passing through the fuser assembly 48A.

As another example, a substrate detector may be located in the printer 10 in a location in the substrate path where substrates 36 that have passed through the fuser have entered a duplex paper path provided to allow the printer 10 to convey the substrate 36 through the image transfer station 34 a second time such that the substrate 36 may be printed on an opposite side. Because the substrate 36 passes through the fuser assembly 48A a second time to fuse a toner image on the opposite side but passes through a substrate detector located in the duplex paper path only once, the substrate count module 138 of the controller 80 may add two to the substrate count to account for two fusing operations corresponding to a fusing operation to fuse a toner image on each side of the substrate 36.

A media type module 142 is also provided within the controller 80. The media type module 142 is configured to determine a media type of the substrate 36 that is to be fused in the fuser assembly 48A. The media type module 142 may acquire media type information from a media type sensor, an operator control panel, a print driver module, or a print data stream. The fuser temperature control module 134 may control the fusing temperature of the fuser assembly 48A in accordance with the media type as determined by the media type module 142. Furthermore, a unique substrate count corresponding to a total number of substrates 36 of each of a plurality of media types that have passed through the fuser assembly 48A may be compiled by the substrate count module 138.

Also included in the controller 80 is a fuser temperature compensation module 144. The fuser temperature compensation module 144 is configured to compensate the fusing temperature of the fuser assembly 48A in accordance with the substrate count as will be described more thoroughly herein.

A storage device 146 is connected to the controller 80. The storage device 146 may comprise NVRAM or any other suitable storage for non volatile storage of program and data information for use by the controller 80. For example, the previously mentioned plurality of substrate counts corresponding to different media types may be stored in the storage device 146.

In accordance with an aspect of the present invention, the fuser temperature control module 134 may operate the fuser assembly 48A at a predetermined initial fusing temperature, hereinafter a temperature setpoint, for example, 175 degrees Centigrade (C), when fusing toner images on a substrate 36 comprising 20 lb. (75 g/m$^2$) plain paper. The fuser assembly 48A may be expected to fuse 120,000, 20 lb. plain paper substrates 36 while maintaining adequate fusegrade before replacement of the nip forming members may be recommended. In order to extend the lifetime of the fuser assembly 48A the fuser temperature compensation module 144 may adjust the temperature setpoint downward by, for example, 3 degrees C to 172 degrees C, after a total of 15,000, 20 lb. plain paper substrates 36 have been fused. The reduction in the temperature setpoint and the corresponding reduction in fusing temperature contributes to an extension of the operating lifetime of the fuser assembly 48A during the period of the fuser lifetime after the initial 15,000 substrates 36 have been fused. It may not be necessary to make any further adjustments in fusing temperature over the remaining lifetime of the fuser assembly 48A.

In accordance with another aspect of the present invention, the fuser temperature compensation module 144 may adjust the temperature setpoint downward a first time to 172 degrees C. after a total of 15,000, 20 lb. plain paper substrates 36 have been fused as previously described. Subsequently, the fuser temperature compensation module 144 may adjust the fusing temperature by a second predetermined amount, for example, by −4 degrees C. from the initial setpoint value to 171 degrees C, after a total of 30,000, 20 lb. plain paper substrates 36 have been fused. The second reduction in the temperature setpoint contributes to an extension of the operating lifetime of the fuser during the period of the fuser lifetime after the initial 30,000 substrates 36 have been fused. Further, the temperature setpoint may be adjusted by a third amount, for example, by −5 degrees C from the initial setpoint value to 170 degrees C, after a total of 40,000, 20 lb. plain paper substrates 36 have been fused. The third reduction in the temperature setpoint contributes to an extension of the operating lifetime of the fuser during the period of the fuser lifetime after the initial 40,000 substrates 36 have been fused. Still further, the temperature setpoint may be adjusted by a fourth amount, for example, by −6 degree C from the initial setpoint value to 169 degrees C, after a total of 50,000, 20 lb. plain paper substrates 36 have been fused. The fourth reduction in the temperature setpoint contributes to an extension of the operating lifetime of the fuser during the period of the fuser lifetime after the initial 50,000 substrates 36 have been fused.

The above adjustment examples are presented by way of illustration and not by way of limitation. In practice, other temperature setpoint adjustment amounts may be made. Moreover, the substrate count events corresponding to temperature adjustments may be different than the above example. Still further, additional or fewer adjustments may be made. The implemented adjustments may be based, for example, upon factors such as the particular components and component characteristics of the particular fuser assembly and of the particular substrates and fusing requirements of particular applications.

Though the preceding discussion refer to substrates 36 comprising 20 lb. plain paper sheets, the present invention is not limited to such material and is applicable to any media type to which toner images may be fused, e.g., card stock, labels, envelopes, transparency stock, heavier or lighter weight paper, etc. For example, 110 lb. card stock may require a higher initial fusing temperature than 20 lb. plain paper. The fuser assembly 48A in accordance with the principles and concepts of the present invention may operate at the higher fusing temperature when fusing images onto substrates 36 comprising 110 lb. card stock. The fuser assembly 48A may then operate at an adjusted fusing temperature after a predetermined number of substrates 36 comprising 110 lb. card stock have been fused in order to extend the operating lifetime of the fuser assembly 48A. The temperature adjustment amount may be determined empirically and may be a greater or lesser adjustment than the temperature adjustment previously discussed with respect to 20 lb. plain paper substrates 36. Furthermore, the number of temperature adjustments performed over the lifetime of the fuser assembly 48A may be more or fewer than the number of adjustments made when processing 20 lb. plain paper substrates 36.

In yet another aspect of the present invention, the substrate count module 138 may compile a plurality of substrate counts corresponding to a total number of substrates 36 of a plurality of different media types that have passed through the fuser assembly 48A. When the media type module 142 determines that a substrate 36 about to be fused by the fuser assembly 48A is of a specific media type, the controller 80 may set the temperature setpoint to a specific value corresponding to a fusing temperature corresponding to the specific media type. The fuser temperature control module 134 may now control the heating structure 124 such that the fusing temperature corresponds to the temperature setpoint corresponding to the specific media type. Further, the fuser temperature compensation module 144 may adjust the temperature setpoint upward or downward when the specific substrate count corresponding to the specific media type to be fused corresponds with a predetermined substrate count value as previously described. In this way, the fuser temperature control module 134 may now adjust the fusing temperature in accordance with the compensated temperature setpoint. As previously described, the temperature setpoint may be adjusted once or a plurality of times during the lifetime of the fuser assembly 48A and the fusing temperature may be adjusted downward or upward as a result.

According to an aspect of the present invention, substrates 36 comprising media types that are rarely fused by the fuser assembly 48A may have little effect upon the operating life of the fuser assembly 48A, and the temperature compensation module 144 may ignore compensating the temperature setpoint when such substrates are fused.

In yet another aspect of the present invention, a temperature compensation table may be provided. An exemplary temperature compensation table is shown below:

| Temperature Compensation Table | |
|---|---|
| Predetermined Count Threshold | Temperature Compensation Value Degrees C. |
| 0-14,999 | 0 |
| 15,000-29,999 | −3 |
| 30,000-39,999 | −4 |
| 40,000-49,999 | −5 |
| 50,000->50,000 | −6 |

The exemplary temperature compensation table includes a plurality of compensation table records. Each compensation table record includes a predetermined count threshold component and a corresponding temperature compensation value component. The predetermined count threshold corresponds to a substrate count event when the fusing temperature is to be compensated, and the corresponding temperature compensation value indicates the amount of the temperature compensation. As substrates 36 pass through the fuser assembly 48A, the substrate count module 138 compiles a substrate count corresponding to a total number of substrates 36 that have been fused as previously described.

The controller 80 compares the substrate count to the predetermined count threshold values in the temperature compensation table and the fuser temperature compensation component 144 adjusts the setpoint temperature in accordance with the corresponding temperature compensation value from the temperature compensation table. For example, as each substrate 36 is fused in the fuser assembly 48A, the substrate count module 138 increments the substrate count by one and compares the new substrate count value to the temperature compensation table predetermined count threshold values. In the example above, the fuser temperature compensation module 144 does not adjust the setpoint temperature until the substrate count reaches 15,000 because the temperature compensation table records indicate a temperature compensation value of 0 for all predetermined count threshold values less than 15,000.

When the substrate count reaches 15,000 the fuser temperature compensation module 144 adjusts the temperature setpoint by the corresponding temperature compensation value, e.g., −3 degrees C. in the illustrated example. When the substrate count reaches 30,000, the fuser temperature compensation module 144 adjusts the temperature setpoint by the corresponding temperature compensation value, e.g., −4 degrees C. When the substrate count reaches 40,000 the fuser temperature compensation module 144 adjusts the temperature setpoint by the corresponding temperature compensation value, e.g., −5 degrees C. In like fashion, when the substrate count reaches 50,000 the fuser temperature compensation module 144 adjusts the temperature setpoint by the corresponding temperature compensation value, e.g., −6 degrees C. In the illustrated example, the temperature compensation value remains −6 degrees C. for all substrate count values above 50,000.

The temperature compensation table may be stored in the storage device 146 where it may be accessed by the controller 80. The controller 80 may include a table address pointer for specifying which compensation table record to access and the table address pointer may be stored in the storage device 146.

The number of compensation table records and the predetermined count threshold values and corresponding temperature compensation values may be determined empirically by the fuser designers and are not limited to the exemplary compensation table values illustrated above. For example, the temperature compensation table may include more or fewer compensation table records, and other embodiments of the present invention may include different predetermined count and temperature compensation value data than the exemplary temperature compensation table depicted above. For example, the temperature compensation data may be represented in fashions other than offsets from the initial set point value.

In another aspect of the present invention, a plurality of temperature compensation tables may be provided. Each of the plurality of temperature compensation tables may correspond to one of a plurality of media types that may be processed by the fuser assembly 48A. Each of the plurality of temperature compensation tables may include a plurality of compensation table records comprising a predetermined count threshold component and a corresponding temperature compensation value component corresponding to a specific media type. In this fashion, individual temperature compensation tables may be provided comprising predetermined count threshold values and corresponding temperature compensation values to be used when fusing substrates 36 of a plurality of differing media types. A plurality of table address pointers corresponding to each of the plurality of temperature compensation tables may be provided for specifying which compensation table record to access. The plurality of temperature compensation tables and the plurality of corresponding table address pointers may be stored in the storage device 146.

Figure 3:
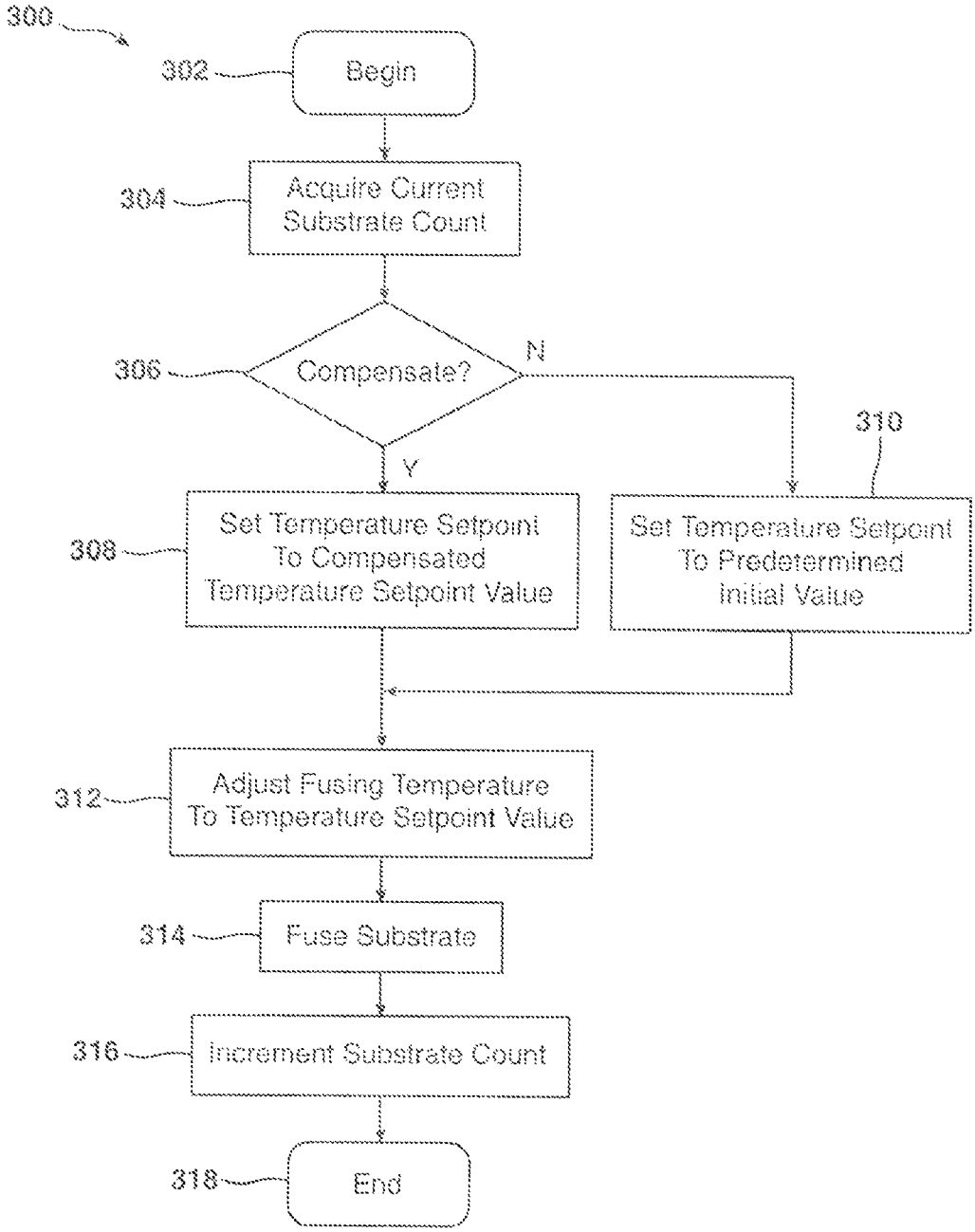
FIG. 3 is a flow chart illustrating how an aspect of the present invention may be practiced.

Referring now to FIG. 3, a flowchart 300 illustrates process steps implemented by the controller 80 for practicing an aspect of the present invention. The controller 80 may implement the process steps indicated in FIG. 3 each time a toner image is to be fused to a substrate 36 by the fuser assembly 48A. The temperature compensation process begins at step 302. When the controller 80 determines that a substrate 36 is to be fused by the fuser assembly 48A, the process proceeds to step 304.

In step 304, the controller may optionally retrieve the current substrate count from the substrate count module 138. Alternatively, the controller 80 may retrieve the current substrate count from the substrate count module 138 prior to step 304. The process now proceeds to step 306.

In step 306, the controller 80 determines if it is appropriate to compensate the temperature setpoint. If the controller 80 determines that temperature compensation is not indicated in step 306 the process proceeds to step 310. If the controller 80 determines that temperature compensation is appropriate in step 306, the process proceeds to step 308.

In step 308 the fuser temperature compensation module 144 compensates the temperature setpoint by adjusting the temperature setpoint value to equal a compensated temperature setpoint value. The compensated temperature setpoint value is configured to extend the operating life of the fuser assembly 48A as previously described. The compensated temperature setpoint value may be retrieved from, for example, a table or other logical arrangement stored in the storage device 146. The process now proceeds to step 312.

In step 310, the controller 80 may set the temperature setpoint value to a predetermined initial value. Alternatively, the temperature setpoint value may be set to the predetermined initial value prior to step 310. The process now proceeds to step 312.

In step 312, the fuser temperature control module 134 adjusts the fusing temperature of the fuser assembly 48A to correspond with the temperature setpoint value as determined in step 308 or 310, at least during fusing operations. The process now proceeds to step 314.

In step 314, the substrate 36 is fused by the fuser assembly 48A at a fusing temperature corresponding to the temperature setpoint value as determined in step 308 or 310. The process now proceeds to step 316.

In step 316 the substrate count module 138 increments the substrate count by one so that the substrate count now corresponds to a total number of substrates 36 fused by the fuser assembly 48A including the substrate 36 just fused. The substrate count module 138 may store the new substrate count value in the storage device 146. The process now proceeds to step 318.

Step 318 is an ending step where the process may stop. Alternatively, the process may proceed to step 302 where the process may begin again when the controller 80 determines that another substrate 36 is to be fused by the fuser assembly 48A.

Figure 4:
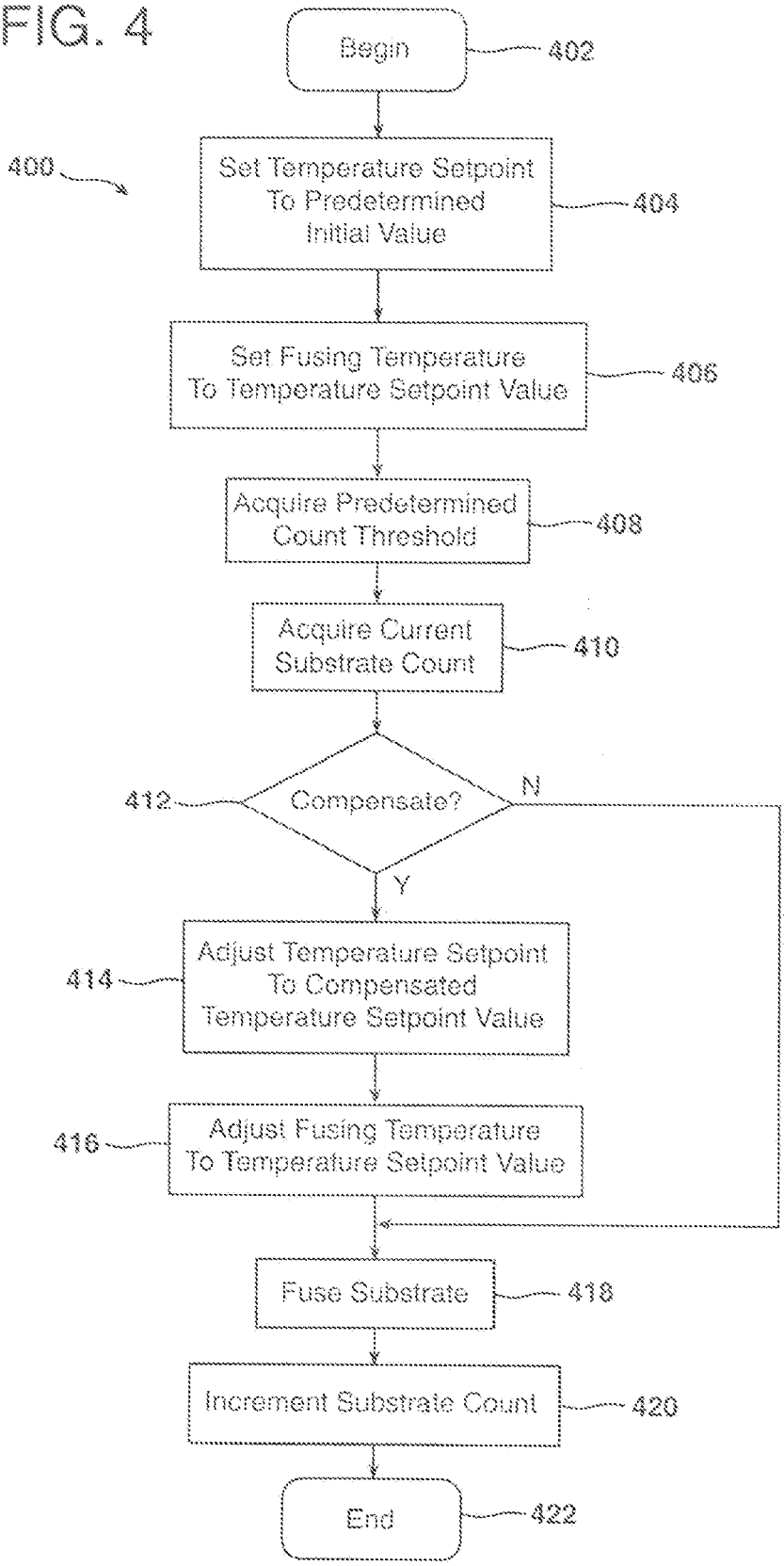
FIG. 4 is a flow chart illustrating how another aspect of the present invention may be practiced.

Referring now to FIG. 4, a flowchart 400 illustrates process steps implemented by the processor 80 for practicing another aspect of the present invention. The controller 80 may implement the process steps indicated in FIG. 4 each time a toner image is to be fused to a substrate 36 by the fuser assembly 48A. The temperature compensation process begins at step 402. When the controller 80 determines that a substrate 36 is to be fused by the fuser assembly 48A, the process proceeds to step 404.

In step 404, the controller 80 sets the temperature setpoint value to a predetermined initial value corresponding to a desired fusing temperature. The predetermined initial value may be determined by the fuser designers and may have been stored in the storage device 146 before the process begins at step 402. The temperature setpoint value may optionally be stored in the storage device 146. The process now proceeds to step 406.

In step 406, the fuser temperature control module 134 controls the heating structure 124 such that the fusing temperature of the fuser assembly 48A corresponds to the temperature setpoint value at least during fusing operations. The fuser temperature control module 134 may cause the heating structure 124 to raise the fusing temperature of the fuser assembly 48A to a temperature corresponding to the temperature setpoint value only during a time when a substrate 36 is being fused in the fuser assembly 48A. Alternatively, the fuser temperature control module 134 may cause the heating structure 124 to raise the fusing temperature of the fuser assembly 48A to a temperature corresponding to the temperature setpoint value in advance of a time when the substrate 36 is to be fused in the fuser assembly 48A. The process now proceeds to step 408.

In step 408, the controller 80 acquires a predetermined count threshold corresponding to a substrate count event when the temperature setpoint value shall be compensated. The predetermined count threshold may be determined by the fuser designers and may have been stored in the storage device 146 before the process begins at step 402. The process now proceeds to step 410.

In step 410, the controller 80 acquires the current substrate count from the substrate count module 138. The process now proceeds to step 412.

In step 412, the controller 80 determines if it is appropriate to compensate the temperature setpoint value from the predetermined initial value to which it was set in step 404. The controller 80 may do this by comparing the substrate count to the predetermined count threshold acquired in step 408. If the substrate count does not correspond to the predetermined count threshold, the process proceeds to step 418. If the substrate count corresponds to the predetermined count threshold, the process proceeds to step 414.

In step 414 the fuser temperature compensation module 144 compensates the temperature setpoint creating a compensated temperature setpoint value. The compensated temperature setpoint value is configured to extend the operating life of the fuser assembly 48A as previously described. The process now proceeds to step 416.

In step 416 the fuser temperature control module 134 adjusts the fuser assembly 48A fusing temperature to correspond with the compensated temperature setpoint value. The process now proceeds to step 418.

In step 418, the substrate 36 is fused at a fusing temperature corresponding to the temperature setpoint value as determined in step 404 or 414. The process now proceeds to step 420.

In step 420 the substrate count module 138 increments the substrate count by one so that the substrate count now corresponds to a total number of substrates 36 fused by the fuser assembly 48A including the substrate 36 just fused. The substrate count module 138 may store the new substrate count value in the storage device 146. The process now proceeds to step 422.

Figure 5:
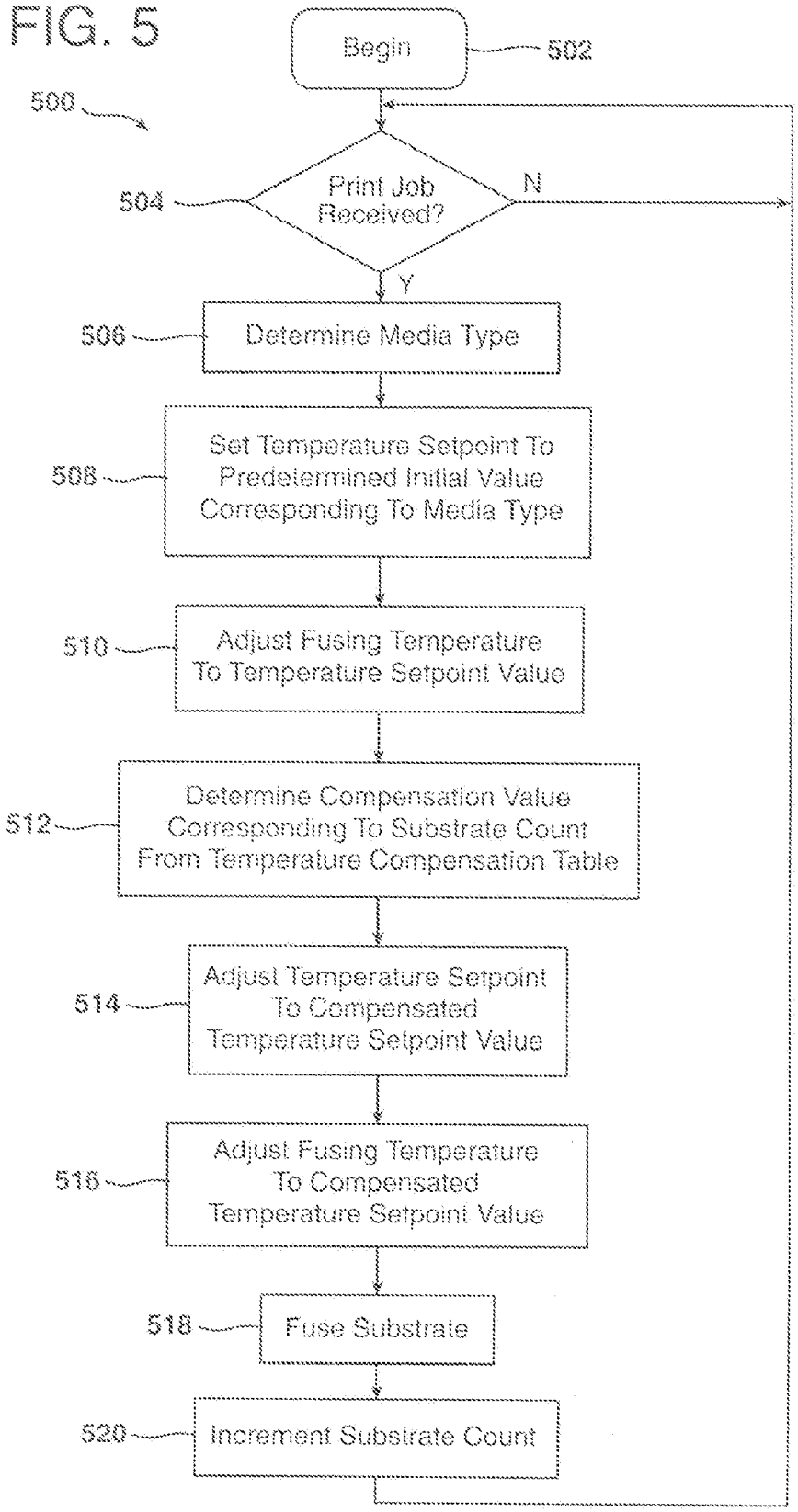
FIG. 5 is a flow chart illustrating how another aspect of the present invention may be practiced.

Step 422 is an ending step where the process may stop. Alternatively, the process may proceed to step 402 where the process may begin again when the controller 80 determines that another substrate 36 is to be fused by the fuser assembly 48A Referring now to FIG. 5, a flowchart 500 illustrates process steps implemented by the controller 80 for practicing another aspect of the present invention. The controller 80 may implement the steps indicated in FIG. 5 each time a print job is received by the printer 10. A print job may comprise the printing of one or more substrates 36 of the same or different media type. Beginning at step 502, the controller 80 is initially in an idle state such as when the printer 10 is initially turned on or when no print jobs have been received by the printer 10.

In step 504, the process waits until the controller 80 determines that a print job has been received. The process then proceeds to step 506.

In step 506, the media type module 142 determines which of a plurality of media types the substrate 36 comprises. Indication of a specific media type may be stored in the storage device 146. The process now proceeds to step 508.

In step 508, the controller 80 sets the temperature setpoint value to a predetermined initial value corresponding to one of a plurality of media types that may be fused in the fuser assembly 48A. The predetermined initial value corresponds to a desired fusing temperature for the media type of the substrate 36 about to be fused. The predetermined initial value may be determined by the fuser designers and may have been stored in the storage device 146 before processing begins at step 502. For example, the predetermined initial value corresponding to the desired fusing temperature for the specific media type may have been stored in a table or other logical arrangement in the storage device 146. The processing now proceeds to step 510.

In step 510, the controller 80 fuser temperature control module 134 controls the fuser assembly 48A heating structure 124 such that the fusing temperature corresponds to the temperature setpoint value as set in step 508 at least during fusing operations. In this fashion, the fusing temperature corresponds to the desired fusing temperature for the media type of the substrate 36 about to be fused. The fuser temperature control module 134 may cause the heating structure 124 to raise the fusing temperature of the fuser assembly 48A to the temperature corresponding to the temperature setpoint value only during a time when the substrate 36 is being fused in the fuser assembly 48A. Alternatively, the fuser temperature control module 134 may cause the heating structure 124 to raise the fusing temperature of the fuser assembly 48A to the temperature corresponding to the temperature setpoint value in advance of a time when the substrate 36 is to be fused in the fuser assembly 48A. The processing now proceeds to step 512.

In step 512, the controller 80 determines a temperature compensation value to be used by the fuser temperature compensation module 144 to compensate the temperature setpoint as will be discussed next. The controller 80 may retrieve the temperature compensation value from a temperature compensation table as previously described. For example, the controller 80 may maintain a table address pointer to provide a table address of a temperature compensation table record that includes a predetermined count threshold and a corresponding temperature compensation value. The controller 80 may maintain a plurality of table address pointers corresponding to a plurality of temperature compensation tables, each of which includes a plurality of records including a predetermined count threshold component and a corresponding temperature compensation value component corresponding to a specific media type. Each of the plurality of table address pointers may be stored in the storage device 146. The process now proceeds to step 514.

In step 514, the fuser temperature compensation module 144 compensates the temperature setpoint value creating a compensated temperature setpoint value. The compensated temperature setpoint value is a sum of the predetermined initial value to which the temperature setpoint was set in step 508 and the temperature compensation value as determined in step 514. The compensated temperature setpoint value is configured to extend the operating life of the fuser assembly 48A. The compensated temperature setpoint value may be stored in the storage device 146. The process now proceeds to step 516.

In step 516, the fuser temperature control module 134 controls the fuser heating structure 124 such that the fusing temperature of the fuser assembly 48A corresponds to the compensated temperature setpoint value. The process now proceeds to step 520.

In step 518, the substrate 36 is fused at the fusing temperature corresponding to the compensated temperature setpoint value and the process waits until fusing of the substrate 36 is finished. When the fuser assembly 48A has finished fusing the substrate 36, the process continues to step 520.

In step 520, the substrate count module 138 increments the substrate count by one so that the substrate count now indicates a total number of substrates 36 fused by the fuser assembly 48A including the substrate 36 just fused. The substrate count module 138 may compile and maintain a plurality of individual substrate counts corresponding to a plurality of substrates 36 of a plurality of media types as determined by the media type module 142 and fused in the fuser assembly 48A. Individual substrate counts for substrates 36 of certain media types that are rarely processed by the printer 10 and fused in the fuser assembly 48A may not be compiled and maintained. Each of the plurality of substrate counts may be stored in the storage device 146. Upon completion of step 520, the process returns to step 504 where the process waits until another print job has been received or another substrate 36 within the same print job is detected.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of controlling a fusing temperature in a fuser assembly, comprising:

setting a temperature setpoint value to a predetermined initial value;

setting said fusing temperature to correspond with said temperature setpoint value at least during fusing operations;

providing a predetermined count threshold corresponding to a substrate count event;

counting a number of substrates conveyed through said fuser assembly defining a substrate count;

comparing said substrate count to said predetermined count threshold;

performing a temperature compensation if said substrate count corresponds to said predetermined count threshold comprising:

adjusting said temperature setpoint value to a compensated temperature setpoint value; and adjusting said fusing temperature to correspond with said compensated temperature setpoint value, wherein said compensated temperature setpoint value is configured to compensate for an expected change in area of a fusing region of said fuser assembly;

wherein said predetermined initial value is based on an initial size of said area of said fusing region, said predetermined count threshold corresponds to a number of substrates conveyed through said fuser assembly during a number of fusing operations when said fusing region is substantially at said initial size of said area thereof;

wherein said providing a predetermined count threshold corresponding to a substrate count event further comprises providing at least one additional predetermined count threshold, said comparing said substrate count to said predetermined count threshold comprises comparing said substrate count to at least one of said predetermined count threshold and said at least one additional predetermined count threshold, and said performing a temperature compensation if said substrate count corresponds to said predetermined count threshold further comprises performing an adjustment for each substrate count that corresponds to an associated one predetermined count threshold by:

adjusting said temperature setpoint value to an associated compensated temperature setpoint value; and adjusting said fusing temperature to correspond with said associated compensated temperature setpoint value;

wherein said adjusting said fusing temperature to correspond with said associated compensated temperature setpoint value comprises adjusting said fusing temperature so as to lower said fusing temperature each time said temperature setpoint value is adjusted without ever increasing said compensated temperature setpoint value for said fusing assembly during a remaining lifetime of said fusing assembly.

2. The method of claim 1, wherein said adjusting said temperature setpoint value to a compensated temperature setpoint value comprises adjusting said temperature setpoint value to a value that is less than said predetermined initial value.

3. The method of claim 1, wherein said adjusting said temperature setpoint value to a compensated temperature setpoint value comprises configuring said compensated temperature setpoint value to maintain said fusing temperature within a temperature operating window.

4. The method of claim 1, wherein said adjusting said temperature setpoint value to a compensated temperature setpoint value comprises:

adjusting said compensated temperature setpoint to a value that is greater than said predetermined initial value; and configuring said compensated temperature setpoint value to maintain said fusing temperature within a temperature operating window.

5. The method according to claim 1, wherein said adjusting said temperature setpoint value to an associated compensated temperature setpoint value comprises maintaining said fusing temperature within a temperature operating window.

6. The method according to claim 1, wherein said counting a number of substrates conveyed through said fuser assembly defining a substrate count comprises counting only if a conveyed substrate comprises at least one corresponding media type.

7. The method according to claim 1, wherein:

said setting a temperature setpoint value to a predetermined initial value further comprises providing a plurality of temperature setpoint values, each corresponding to an associated media type and having a corresponding initial value; and said setting said fusing temperature to correspond with said temperature setpoint value at least during fusing operations further comprises setting said fusing temperature to correspond with a select one of said plurality of temperature setpoint values based upon an associated media type at least during fusing operations.

8. A fuser assembly within an image forming apparatus having a paper path along which substrates travel through the image forming apparatus comprising:

a fusing member;

a backup member cooperating with said fusing member to form a fusing region at a nip therebetween for fusing images onto substrates passing through said fusing region;

a heating structure associated with at least one of said fusing member and said backup member for heating said fusing region to a fusing temperature at least during fusing operations, said fusing temperature corresponding to a temperature setpoint value, said temperature setpoint value being set to a predetermined initial value;

a conveying structure for conveying substrates along said paper path into said nip;

a substrate detector for determining a number of substrates passing through said nip; and a controller for controlling said fusing temperature, wherein said controller counts said number of substrates passing through said nip defining a substrate count, compares said substrate count to a predetermined count threshold and performs a temperature compensation if said substrate count corresponds to said predetermined count threshold, wherein said temperature compensation:

adjusts said temperature setpoint value to a compensated temperature setpoint value;

adjusts said fusing temperature to correspond with said compensated temperature setpoint, wherein said compensated temperature setpoint value is configured to compensate for an expected change in an area of said fusing region of said fuser assembly;

wherein said predetermined initial value is based on an initial area of said fusing region;

wherein said controller compares said substrate count to at least one additional redetermined count threshold corresponding to a substrate count and performs a temperature compensation for each substrate count that corresponds to an associated one predetermined count threshold, wherein said temperature compensation further:

adjusts said temperature setpoint value to an associated compensated temperature setpoint value; and adjusts said fusing temperature to correspond with said associated compensated temperature setpoint value, wherein said associated compensated temperature setpoint value is adjusted so as to lower said fusing temperature each time said temperature setpoint value is adjusted without ever raising said fusing temperature of said heating structure above said associated compensated temperature setpoint value during a remaining lifetime of said fuser assembly.

9. The fuser assembly of claim 8, wherein said compensated temperature setpoint value is less than said predetermined initial value.

10. The fuser assembly of claim 8, wherein said compensated temperature setpoint value is configured to maintain said fusing temperature within a temperature operating window.

11. The fuser assembly of claim 8, wherein said compensated temperature setpoint value is greater than said predetermined initial value and said associated compensated temperature setpoint value is configured to maintain said fusing temperature within a temperature operating window.

12. The fuser assembly of claim 8, wherein said associated compensated temperature setpoint value is configured to maintain said fusing temperature within a temperature operating window.

13. The fuser assembly of claim 8, wherein said controller counts only those substrates passing through said nip that correspond to at least one associated media type for purposes of temperature compensation.

14. The fuser assembly of claim 8, further comprising:

a plurality of temperature setpoint values, each corresponding to an associated media type and having a corresponding initial value, wherein said fusing temperature is set to correspond with a select one of said plurality of temperature setpoint values based upon an associated media type.

* * * * *